US005589445A

United States Patent [19]

Leahy et al.

[11] Patent Number: 5,589,445

[45] Date of Patent: Dec. 31, 1996

[54] OVERBASED METAL SALTS, THEIR PREPARATION AND USE

[75] Inventors: Richard Leahy; Stephen J. Cook, both of North Humberside, United Kingdom

[73] Assignee: BP Chemicals (Additives) Limited, London, England

[21] Appl. No.: 517,235

[22] Filed: Aug. 21, 1995

[30] Foreign Application Priority Data

Aug. 19, 1994 [GB] United Kingdom ..... 9416838

[51] Int. Cl.[6] ..... C10M 159/20; C10M 159/22

[52] U.S. Cl. ..... 508/381; 508/574; 508/585; 508/586

[58] Field of Search ..... 252/18, 25

[56] References Cited

U.S. PATENT DOCUMENTS

| | | | |
|---|---|---|---|
| 3,746,698 | 7/1973 | Hunt et al. | 260/137 |
| 3,793,201 | 2/1974 | Karn | 252/33.4 |
| 4,049,560 | 9/1977 | Dominey | 252/33.3 |
| 4,252,698 | 2/1981 | Ito et al. | 260/18 EP |
| 4,664,822 | 5/1987 | Hunt et al. | 252/32.7 E |
| 4,767,551 | 8/1988 | Hunt et al. | 252/32.7 E |
| 5,114,601 | 5/1992 | Cook et al. | 252/25 |
| 5,162,085 | 11/1992 | Cane et al. | 252/18 |
| 5,205,946 | 4/1993 | Cook et al. | 252/18 |
| 5,397,484 | 3/1995 | Cane et al. | 252/18 |
| 5,433,871 | 7/1995 | O'Connor et al. | 252/18 |
| 5,441,652 | 8/1995 | O'Connor et al. | 252/25 |

FOREIGN PATENT DOCUMENTS

WO93/06195 4/1993 WIPO .

*Primary Examiner*—Ellen M. McAvoy
*Attorney, Agent, or Firm*—Nixon & Vanderhyde

[57] ABSTRACT

An overbased metal salt of a hydrocarbyl-substituted sulphurised or non-sulphurised phenol, a calixarene having a substituent hydroxyl group or groups available for reaction with metal base or a linear phenol/formaldehyde resin wherein the metal moiety comprises a first metallic component which is at least one alkaline earth metal and a second metallic component which is at least one of either (i) at least one alkali metal or (ii) at least one metal selected from Groups IIIa, IVa, Va, VIa, VIIa and VIII of either the first or the second transition series of the Periodic Table of the Elements, the weight ratio of the first metal component to the second metal component being in the range from 1000:1 to 2:1.

21 Claims, 1 Drawing Sheet

FIGURE
EFFECT OF SULPHURIC ACID CONCENTRATION ON FRICTION FOR 70 BN PHENATE SOLUTIONS IN 500N HVI MINERAL OIL
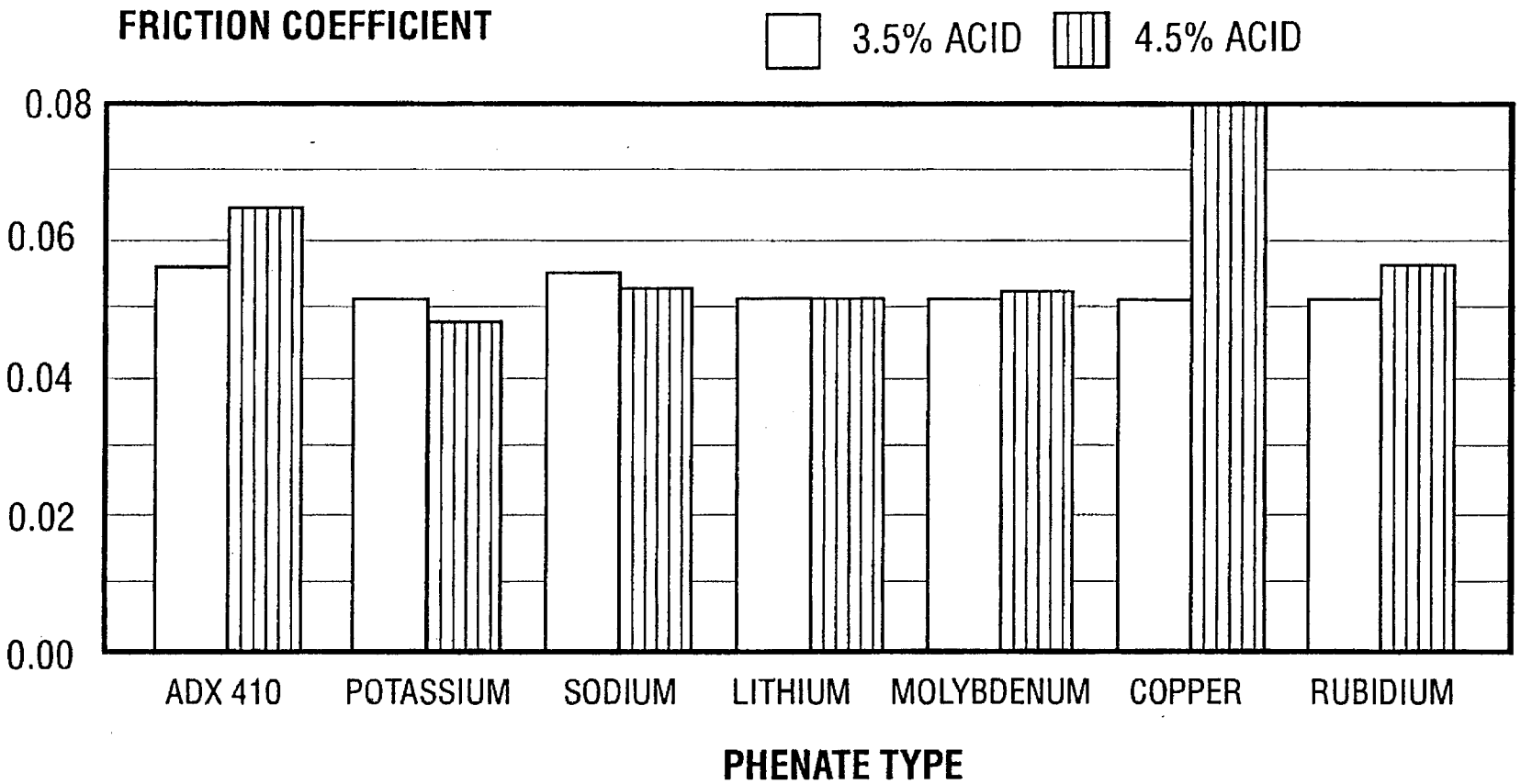

OVERBASED METAL SALTS, THEIR PREPARATION AND USE

The present invention relates in general to overbased alkaline earth metal salts of sulphurised or non-sulphurised hydrocarbyl-substituted phenols, calixarenes and linear phenol/formaldehyde resins, their preparation and their use as additives in lubricating oils and fuels.

BACKGROUND OF THE INVENTION

In the internal combustion engine, by-products from the combustion chamber often blow by the piston and admix with the lubricating oil. Many of these by-products form acidic materials within the lubricating oil. This is particularly marked in diesel engines operating on low-grade fuels of high sulphur content wherein corrosive acids are produced by combustion. The acids thereby incorporated in the lubricating oil can include sulphur acids produced by oxidation of sulphur, hydrohalic acids derived from halogen lead scavengers in the fuel and nitrogen acids produced by the oxidation of atmospheric nitrogen within the combustion chamber. Such acids cause deposition of sludge and corrosion of the bearings and engine parts leading to rapid wear and early breakdown of the engine.

One class of compounds generally employed to neutralise the acidic materials and disperse sludge within the lubricating oil are the metal alkyl phenates, wherein the metal is an alkaline earth metal such as calcium, magnesium or barium. Both "normal" and "overbased" alkaline earth metal alkyl phenates have been employed. The term "overbased" is used to describe those alkaline earth metal alkyl phenates in which the ratio of the number of equivalents of the alkaline earth metal moiety to the number of equivalents of the phenol moiety is greater than one, and is usually greater than 1.2 and may be as high as 4.5 or greater. In contrast, the equivalent ratio of alkaline earth metal moiety to phenol moiety in "normal" alkaline earth metal alkyl phenates is one. Thus, the "overbased" material contains greater than 20% in excess of the alkaline earth metal present in the corresponding "normal" material. For this reason "overbased" alkaline earth metal alkyl phenates have a greater capability for neutralising acidic matter than do the corresponding "normal" alkaline earth metal alkyl phenates.

Other classes of compounds said to be useful for the same purpose are the overbased metal salts of calixarenes as described for example in EP-A-0450874 and the overbased metal salts of linear phenol/formaldehyde resins.

DESCRIPTION OF THE INVENTION

Whilst the aforesaid compounds perform perfectly adequately as detergents, there remains scope for improvement in other properties. Thus, for example, a desirable objective would be to improve the anti-wear and frictional properties of the overbased alkaline earth metal non-sulphurised hydrocarbyl-substituted phenates. We have found that these and other properties of the aforesaid detergents can be improved by incorporating into them in addition to the alkaline earth metal at least one further metal typically an alkali metal, e.g. lithium, sodium or potassium in relatively small amounts.

The use of mixtures of an alkaline earth metal and another metal in lubricating oil compositions is known from, for example, WO-A-93/03 121; WO-A-93/06195; U.S. Pat. No. 4,767,551; U.S. Pat. No. 4,664,822; U.S. Pat. No. 4,252,698; and U.S. Pat. No. 3,793,201.

WO-A-93/03121 describes overbased metal salts of hydrocarbyl-substituted phenols wherein the metal moiety is an alkali or alkaline earth metal, copper or zinc, preferably sodium, potassium, calcium or magnesium, and their use in combination with other components for improving the wet filterability of lubricants and functional fluids.

WO-A-93/06195 discloses the use of ultrasound in the preparation of oil-soluble sulphonates, phenates, sulphurised phenates, thiophosphonates, salicylates and naphthenates and other carboxylates of a metal, particularly the alkali or alkaline earth metals or magnesium, for example sodium, lithium, calcium, barium and magnesium. The most commonly used metals are said to be calcium and magnesium, mixtures of calcium and magnesium, and mixtures of calcium and/or magnesium with sodium.

U.S. Pat. No. 4,767,551 discloses lubricant compositions comprising inter alia 0.1–5 wt % of a dispersant/detergent, antioxidant and corrosion inhibitor additive comprising an overbased copper/metal sulphonate, phenate and/or salicylate in which the metal is magnesium, calcium or sodium.

U.S. Pat. No. 4,664,822 discloses metal detergent compositions similar to those described in U.S. Pat. No. 4,767,551.

U.S. Pat. No. 4,252,698 discloses an additive for environmentally acceptable stabilised vinyl chloride polymer compositions comprising inter alia at least one overbased metal phenolate or sulphonate of lithium, sodium, magnesium, calcium, strontium and/or barium. An example describes the synthesis of overbased sodium carbonate-barium nonylphenolate.

Finally, U.S. Pat. No. 3,793,201 discloses an oil-soluble composition comprising inter alia (B) an oil-soluble basic magnesium salt of an organic acid and (C) an oil-soluble polyvalent metal salt of a bridged phenol, the amount of (B) and (C) being such that the equivalent ratio of metal contributed to the composition by (B) to that contributed by (C) is 150–30:1. The metal cations of the salts of the bridged phenols may be an alkali or alkaline earth metal cation or a zinc, cadmium, lead, iron, nickel, cobalt, copper, chromium or tin cation or mixtures of these.

None of the aforesaid prior art specifically describes the incorporation of defined metals into overbased alkaline earth metal detergents in amounts which are small relative to the amount of alkaline earth metal for the purpose of improving the detergent's anti-wear and frictional properties.

Accordingly the present invention provides an overbased metal salt of a hydrocarbyl-substituted sulphurised or non-sulphurised phenol, a calixarene having a substituent hydroxyl group or groups available for reaction with metal base or a linear phenol/formaldehyde resin wherein the metal moiety comprises a first metallic component which is at least one alkaline earth metal and a second metallic component which is at least one of either (i) at least one alkali metal, or (ii) at least one metal selected from Groups IIIa, IVa, Va, VIa, VIIa and VIII of either the first or the second transition series of the Periodic Table of the Elements, the weight ratio of the first metal component to the second metal component being in the range from 1000:1 to 2:1.

The weight ratio of the first metallic component to the second metallic component is in the range from 1000:1 to 2:1, typically from 500:1 to 2:1, for example from 150:1 to 2:1.

The overbased metal salt is an overbased metal salt of either a hydrocarbyl-substituted sulphurised or non-sulphurised phenol, or a calixarene having a substituent hydroxyl group or groups available for reaction with metal base or a linear phenol/formaldehyde resin.

As regards the hydrocarbyl-substituted phenol the hydrocarbyl substituent is preferably an alkyl group, which may be branched or unbranched. Suitable alkyl groups contain from 4 to 50, preferably from 9 to 28, carbon atoms. A particularly suitable alkyl phenol is the $C_{12}$-alkyl phenol obtained by alkylating phenol with propylene tetramer. The hydrocarbyl-substituted phenol may be a mono- or a poly-substituted phenol. A particularly suitable poly-substituted phenol is dinonyl phenol. Overbased metal salts of hydrocarbyl-substituted phenols are generally manufactured and sold as concentrates of the metal salt in a suitable lubricating oil. Where sulphur is present in the overbased metal salt the amount of sulphur may suitably be in the range from 1 to 6, typically from 1 to 3% by weight based on the weight of the concentrate.

As regards the calixarene having a substituent hydroxyl group or groups available for reaction with metal base, any suitable calixarene may be employed. This includes both sulphurised and non-sulphurised calixarenes. A preferred calixarene is a sulphur-free calixarene, for example a sulphur-free calixarene as described in EP-A-0450874. Suitable calixarenes may be represented by the formula:

(I)

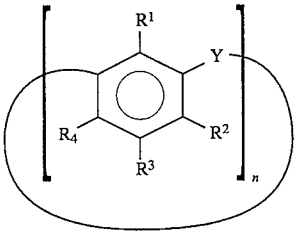

wherein in the formula:

Y is a divalent bridging group;

$R^3$ is a hydrocarbyl or a hetero-substituted hydrocarbyl group;

either $R^1$ is hydroxyl and $R^2$ and $R^4$ are independently either hydrogen, hydrocarbyl or hetero-substituted hydrocarbyl; or $R^2$ and $R^4$ are hydroxyl and $R^1$ is either hydrogen, hydrocarbyl or hetero-substituted hydrocarbyl; and n is an integer in the range from 3 to 12.

A preferred calixarene has the formula:

(II)

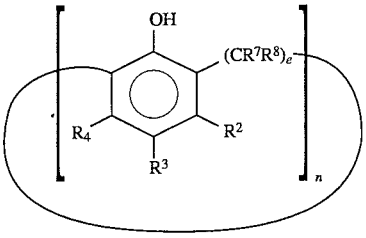

wherein in the formula:

$R^2$, $R^3$ and $R^4$ are independently either hydrogen, hydrocarbyl or hetero-substituted hydrocarbyl;

either one of $R^7$ and $R^8$ is hydrogen and the other is either hydrogen or hydrocarbyl;

n is an integer in the range 4 to 9; and e is one or greater, eg 1, 2, 3 or 4.

An example of a suitable calixarene of the formula (II) is p-tert-butyl calix [6,8] arene. Other suitable calixarenes include p-dodecyl calix[6] arene, p-nonyl calix[8] arene and p-nonyl [6,7,8] arene.

For further details of suitable calixarenes and their preparation reference may be made to the aforesaid EP-A-0450874.

As regards the linear phenol/formaldehyde resin, this may suitably be a resin of the formula:

(III)

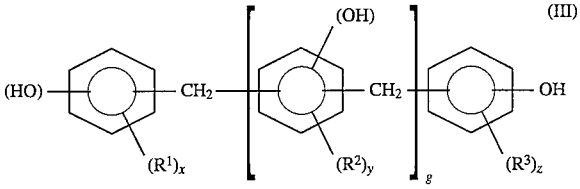

wherein in the formula (III):

$R^1$, $R^2$ and $R^3$ independently represent either hydrogen or a hydrocarbyl group;

x, y and z each independently represent zero or an integer in the range 1 to 3; and g is an integer in the range from 1 to 20.

Preferred resins are those of the formula (III) in which x=y=z=1; $R^1$=$R^2$=$R^3$=a $C_1$ to $C_{24}$, preferably a $C_1$ to $C_{12}$ alkyl group; and g is in the range from 2 to 7, preferably 3. Such compounds are well-known in the art and may be prepared by the condensation of the appropriate phenol with formaldehyde.

The metal moiety of the overbased metal salt comprises a first metallic component which is an alkaline earth metal and a second metallic component which is at least one of either (i) at least one alkali metal, or (ii) at least one metal selected from Groups IIIa, IVa, Va, VIa and VIII of either the first or the second transition series of the Periodic Table of the Elements. For the avoidance of doubt the Periodic Table of the Elements referred to throughout this specification is that to be found in the book entitled 'Advanced Inorganic Chemistry' by Cotton and Wilkinson, published by John Wiley & Sons, Fourth Edition. The metals in Groups IIIa to VIII which comprise the first transition series are Sc, Ti, V, Cr, Mn, Fe, Co and Ni. The metals in Groups IIIa to VIII which comprise the second transition series are Y, Zr, Nb, Mo, Tc, Ru, Rh and Pd.

As regards the first metallic component, suitably the alkaline earth metal is either calcium, magnesium or barium, preferably calcium. As regards the second metallic component, this is preferably either an alkali metal or molybdenum. Of the alkali metals lithium, sodium, potassium, rubidium or caesium preferred are lithium, sodium and potassium. The second metallic component is preferably lithium, potassium or molybdenum.

The overbased metal salts of the present invention will generally take the form of a solution in an appropriate solvent, which will generally be a lubricating oil.

Accordingly in another aspect the present invention provides a concentrate composition which comprises at least one overbased metal salt of either a hydrocarbyl-substituted sulphurised or non-sulphurised phenol, a calixarene having a substituent hydroxyl group or groups available for reaction with metal base or a linear phenol/formaldehyde resin as hereinbefore described and a solvent therefor, the overbased metal salt comprising from greater than 10 to less than 90% by weight of the composition.

The solvent for the overbased metal salt may be any suitable solvent, for example a hydrocarbon solvent, but in view of the intended use of the salt as a lubricating oil additive it is preferably a lubricating oil.

The Total Base Number (TBN) expressed in mg KOH/g of the concentrate may suitably be in the range from 75 to 500, typically in the range from 100 to 450, for example from 150 to 400.

The overbased metal salt comprises from greater than 10 to less than 90, typically from 15 to 80, for example from 20 to 75% by weight of the composition.

A preferred overbased metal salt is a lubricating oil concentrate comprising a metal non-sulphurised alkyl phenate, the concentrate having a TBN of greater than 300 and a viscosity at 100° C. of less than 1000 cSt, the metal being either a mixture of calcium and either lithium or potassium in a weight ratio of calcium to either lithium or potassium in the range from 6:1 to 25:1 or calcium and molybdenum in a weight ratio of calcium to molybdenum of from 6:1 to 50:1, for example 30:1. The presence of potassium or lithium in the overbased phenate more than compensates in terms of antiwear properties for the absence of sulphur, the avoidance of which can be desirable environmentally from the point of view of avoiding the hydrogen sulphide emissions generally associated with the products of sulphurised phenates.

In another aspect the present invention provides a process for the production of an overbased metal salt as hereinbefore described which process comprises reacting at elevated temperature component (A) either (i) an alkaline earth metal hydrocarbyl-substituted sulphurised or non-sulphurised phenate, or (ii) an alkaline earth metal salt of a calixarene having a substituent hydroxyl group or groups available for reaction with a metal base, or (iii) an alkaline earth metal salt of a linear phenol/formaldehyde resin, or (iv) the precursors of either (i) (ii) or (iii), component (B) an alkaline earth metal base added either in a single addition or in a plurality of additions at intermediate points during the reaction, component (C) a solvent comprising either:

(C1 ) either (i) a polyhydric alcohol having 2 to 4 carbon atoms, (ii) a di-($C_2$ to $C_4$) glycol, (iii) a tri- ($C_2$ to $C_4$) glycol or (iv) a mono- or poly-alkylene glycol alkyl ether of the formula:

$$R^3(OR^4)_xOR^5 \quad \text{(IV)}$$

wherein in the formula (IV) $R^3$ is a $C_1$ to $C_6$ alkyl group, $R^4$ is an alkylene group, $R^5$ is hydrogen or a $C_1$ to $C_6$ alkyl group and x is an integer in the range from 1 to 6, either alone or in combination with either (C2) a hydrocarbon solvent or (C3) either (i) water, (ii) a $C_1$ to $C_{20}$ monohydric alcohol, (iii) a ketone having up to 20 carbon atoms, (iv) a carboxylic acid ester having up to 10 carbon atoms or (v) an ether having up to 20 carbon atoms, or, (C4) a $C_1$ to $C_4$ monohydric alcohol in combination with a hydrocarbon solvent, optional component (D) a lubricating oil, component (E) carbon dioxide added subsequent to the, or each, addition of component (B), component (F) either a basic compound or a salt of at least one of either (i) at least one alkali metal, or (ii) at least one metal selected from Groups IIIa, IVa, Va, VIa, VIIa and VIII of either the first or the second transition series of the Periodic Table of the Elements.

optional component (G) sufficient to provide from 2 to 40% by weight based on the weight of the concentrate of at least one compound which is G (i) a carboxylic acid or an acid anhydride, ester or salt thereof, said acid having the formula (V)

$$R^1-\underset{\underset{R^2}{|}}{CH}-COOH \quad \text{(V)}$$

wherein $R^1$ is a $C_{10}$ to $C_{24}$ alkyl or alkenyl group and $R^2$ is hydrogen, a $C_1$ to $C_4$ alkyl group or a $CH_2COOH$ group, or (G) (ii) a poly-carboxylic acid containing from 36 to 100 carbon atoms or an acid anhydride, ester or salt thereof, optional component (H) a catalyst or promoter for the reaction, the amounts of components (B) and (F) being such as to produce an overbased metal salt wherein the weight ratio of the alkaline earth metal of component (B) to the metal of component (F) is in the range from 1000:1 to 2:1.

Component (A) is either (i) an alkaline earth metal hydrocarbyl-substituted sulphurised or non-sulphurised phenate, or (ii) an alkaline earth metal salt of a calixarene having a substituent hydroxyl group or groups available for reaction with a metal base, or (iii) an alkaline earth metal salt of a linear phenol/formaldehyde resin, or (iv) the precursors of either (i), (ii) or (iii). The precursors of (i) are, for example, a hydrocarbyl-substituted phenol, optionally a source of sulphur, an alkaline earth metal base, and optionally carbon dioxide.

It is preferred to employ a pre-formed phenate, calixarate or salt of a phenol/formaldehyde resin. Suitable hydrocarbyl-substituents and alkaline earth metals are discussed hereinbefore in relation to the overbased metal salt.

Component (B) is an alkaline earth metal base added either in a single addition or in a plurality of additions at intermediate points during the reaction. The alkaline earth metal base may suitable be an oxide or hydroxide, preferably the hydroxide. Preferred alkaline earth metals are calcium, magnesium and barium, of which calcium is more preferred. A calcium base may be added, for example, in the form of quick lime (CaO) or in the form of slaked lime [$Ca(OH)_2$] or as a mixture of the two in any proportions. Slaked lime is preferred.

Component (C) is a solvent for the reactants. The solvent (C) may be either ($C_1$) either alone or in combination with either ($C_2$) or ($C_3$), or the solvent (C) may be ($C_4$) in combination with ($C_2$) wherein:

($C_1$) is either (i) a polyhydric alcohol having 2 to 4 carbon atoms, (ii) a di- ($C_3$ or $C_4$) glycol, (iii) a tri-($C_2$ to $C_4$) glycol or (iv) a mono- or poly-alkylene glycol alkyl ether of the formula:

$$R^3(OR^4)_xOR^5 \quad \text{(IV)}$$

wherein in the formula (IV) $R^3$ is a $C_1$ to $C_6$ alkyl group, $R^4$ is an alkylene group, $R^5$ is hydrogen or a $C_1$ to $C_6$ alkyl group and x is an integer from 1 to 6. Suitable compounds having the formula (IV) include the monomethyl or dimethyl ethers of (a) ethylene glycol, (b) diethylene glycol, (c) triethylene glycol or (d) tetraethylene glycol. A suitable compound is methyl diglycol ($CH_3OCH_2CH_2OCH_2CH_2OH$). Mixtures of glycol ethers of formula (IV) and glycols may also be employed. The polyhydric alcohol may suitably be either a dihydric alcohol, for example ethylene glycol or propylene glycol, or a trihydric alcohol, for example glycerol. The di- ($C_2$ to $C_4$) glycol may suitable be dipropylene glycol, the tri- ($C_2$ to $C_4$) glycol may suitable be triethylene glycol. Preferably the component ($C_1$ ) is either ethylene glycol or methyl diglycol.

($C_2$) is a hydrocarbon solvent which may be aliphatic or aromatic. Examples of suitable hydrocarbons include toluene, xylene, naphtha and aliphatic paraffins, for example hexane, and cycloaliphatic paraffins.

($C_3$) may be either (i) water, (ii) a $C_1$ to $C_{20}$ monohydric alcohol, (iii) a ketone having up to 20 carbon atoms, (iv) a carboxylic acid ester having up to 10 carbon atoms or (v) an aliphatic, alicyclic or aromatic ether having up to 20 carbon atoms. Examples are methanol, 2-ethyl hexanol, cyclohexanol, cyclohexanone, benzyl alcohol, ethyl acetate and acetophenone.

($C_4$) may be a $C_1$ to $C_4$ monohydric alcohol, preferably methanol, in combination with a hydrocarbon solvent.

Preferred solvents (C) comprise ethylene glycol, a mixture of ethylene glycol and 2-ethyl hexanol and a mixture of methanol and toluene.

Optional component (D) is a lubricating oil. The lubricating oil may suitably be an animal, a vegetable or a mineral oil. Suitably the lubricating oil is a petroleum—derived lubricating oil, such as a naphthenic base, paraffin base or mixed base oil. Solvent neutral oils are particularly suitable. Alternatively, the lubricating oil may be a synthetic lubricating oil. Suitable synthetic lubricating oils include diesters such as di-octyl adipate, di-octyl sebacate and tri-decyladipate, or polymeric hydrocarbon lubricating oils, for example liquid polyisobutenes and poly-alpha olefins.

Component (E) is carbon dioxide, added subsequent to each addition of component (B). Carbon dioxide may be added in the form of a gas or a solid, preferably in the form of a gas. In gaseous fibrin it may suitably be blown through the reaction mixture.

Component (F) is either a basic compound or a salt of at least one of either (i) at least one alkali metal, or (ii) at least one metal selected from Groups Ilia, IVa, Va, VIa, VIIa and VIII of either the first or the second transition series of the Periodic Table of the Elements. Suitable metals have been discussed hereinbefore in relation to the overbased metal salt. Basic metal compounds include the hydroxides, oxides and alkoxides of the metals. Suitable salts of the metals include the carboxylate salts, for example the formates, acetates and propionates.

Optional component (G) is G(i) a carboxylic acid of formula (V) as defined above or an ester, acid anhydride or a salt thereof, or G(ii) a poly-carboxylic acid containing from 36 to 100 carbon atoms, or an ester, acid anhydride or a salt thereof. The amount of the aforesaid acid should be sufficient to provide from 2 to 40% by weight based on the weight of the concentrate. Preferably $R^1$ in the carboxylic acid of formula (V) is unbranched alkyl or alkenyl. Preferred acids of formula (V) are those wherein $R^1$ is a $C_{10}$ to $C_{24}$, more preferably $C_{18}$ to $C_{24}$, straight chain alkyl, and $R^2$ is hydrogen. Examples of suitable saturated carboxylic acids of formula (V) include captic acid, laurie acid, myristic acid, palmitic acid, stearic acid, isostearic acid, arachidic acid, behenic acid and lignoceric acid. Examples of suitable unsaturated acids of formula (V) include lauroleic acid, myristoleic acid, palmitoleic acid, oleic acid, gadoleic acid, erucic acid, ricinoleic acid, linoleic acid and linolenic acid. Mixtures of acids may also be employed, for example rape top fatty acids. Particularly suitable mixtures of acids are those commercial grades containing a range of acids, including both saturated and unsaturated acids. Such mixtures may be obtained synthetically or may be derived from natural products, for example cotton oil, ground nut oil, coconut oil, linseed oil, palm kernel oil, olive oil, corn oil, palm oil, castor oil, soyabean oil, sunflower oil, herring oil, sardine oil and tallow. Sulphurised acids and acid mixtures may also be employed. Instead of, or in addition to, the carboxylic acid there may be used an ester or acid anhydride, of the acid, preferably the acid anhydride. Where a salt of the carboxylic acid is used, it is preferred that the salt is an alkaline earth metal salt. It is preferred however to use a carboxylic acid or a mixture of carboxylic acids. A preferred carboxylic acid of formula (V) is stearic acid.

Instead of, or in addition to, using (G)(i), G(ii), which is a poly- carboxylic acid containing from 36 to 100 carbon atoms or an ester or acid anhydride thereof can be used. G(ii) is preferably a di- carboxylic acid. Examples are polyisobutene succinic acid or a polyisobutene succinic anhydride.

Optional component (H) is a catalyst or promoter for the reaction The catalyst may be an organic compound or an inorganic compound. Suitable organic compounds include (i) organic halides or (ii) organic alkanoates, which may suitably be represented by the formula:

$$R\text{–}X \qquad \text{(VI)}$$

wherein in the formula (VI) X is either halogen, suitably chlorine, bromine or iodine, preferably chlorine, or the group $OCOR^1$ wherein $R^1$ is suitably $C_1$ to $C_4$ alkyl and R is either an alkyl, aryl or alkaryl group preferably having 3–20 or 6–20 or 7–20 carbons respectively, or a halo-derivative thereof. Alternatively, the organic halide may be an HX salt of an organic base, for example guanidine hydrochloride. A suitable example of an organic halide of the formula (VI) is octyl chloride. Mixtures of (i) and (ii) may also be employed. Suitably the amount of organic compound (G) employed may be up to 2.0% by weight based on the weight of concentrate. Suitable inorganic compound catalysts include inorganic halides, particularly inorganic chlorides, and inorganic alkanoates. Examples of suitable inorganic compound catalysts include calcium acetate, calcium chloride, ammonium chloride, aluminium chloride and zinc chloride, of which calcium chloride and calcium acetate are preferred. Suitably the amounts of the inorganic compound catalyst employed may be up to 2.0% wt/wt based on the weight of the reaction mixture.

In order to produce a concentrate of the metal salt it is very much preferred to employ optional component (D), a lubricating oil, though it would be possible to employ component (C) alone and at the completion of the process replace component (C) with component (D) if desired.

For the production of overbased metal salts in general it is preferred to utilise components (G) and (H) and for the production of the highly overbased salts (TBN greater than 300) it is very much preferred to utilise components (G) and (H).

Preferably the carboxylic acid(s) having the formula (V), or the poly-carboxylic acid or an ester, acid anhydride or salt thereof is incorporated in an amount of 10% to 40%, more preferably 12 to 20%, for example about 16%, by weight based on the weight of the additive concentrate. An advantage of incorporating greater than 10% of the carboxylic acid or derivative thereof is generally that a relatively lower concentrate viscosity results.

Suitably the elevated temperature at which the components are reacted will be in the range from 50° to 250°, preferably from 130° to 165° C. The pressure may suitably be atmospheric, subatmospheric or superatmospheric.

The overbased salt may be recovered as a concentrate in lubricating oil by conventional means, suitably by distillative stripping of component (C). Finally, it is preferred to filter the concentrate so-obtained.

According to another aspect of the present invention there is provided a finished lubricating oil composition comprising a lubricating oil and an overbased metal salt as hereinbefore described in an amount up to 10% by weight of the composition.

Preferably the finished lubricating oil composition contains sufficient of the overbased metal salt to provide a TBN in the range from 0.5 to 150.

The amount of overbased metal salt present in the finished lubricating oil will depend on the nature of the final use. Thus, for marine lubricating oils the amount of salt present may suitably be sufficient to provide a TBN of 9 to 100 and for automobile engine lubricating oils the amount may suitable be sufficient to provide a TBN of 4 to 20.

The finished lubricating oil may also contain effective amounts of one or more other types of conventional lubricating oil additives, for example viscosity index improvers, anti-wear agents, antioxidants, dispersants, rust inhibitors, pour-point depressants, or the like, which may be incorporated into the finished lubricating oil composition either directly or through the intermediary of the concentrate composition.

In another aspect the present invention provides a method of reducing wear in a part of an internal combustion engine which is moveable relative to another part of the engine and susceptible to wear thereby which method comprises applying to the moveable part of the engine an overbased metal salt as hereinbefore described.

The internal combustion engine may suitably be an automobile engine, a marine engine or any other engine, for example an aeroplane engine. The engine may be either a spark ignition, e.g. a gasoline, engine or a spark compression, e.g. a diesel, engine.

A part of an internal combustion engine which is moveable relative to another part is for example a piston within a cylinder.

Another aspect of the present invention is the use of an overbased metal salt as hereinbefore described for reducing wear in a part of an internal combustion engine which is moveable relative to another part of the engine and susceptible to wear thereby.

In a final aspect the present invention provides an internal combustion engine fuel composition comprising a major proportion by weight of an internal combustion engine fuel and a minor proportion by weight of an overbased metal salt as hereinbefore described.

The internal combustion engine fuel may be fuel suitable for an engine of either the spark ignition type (gasoline) or the spark compression type (diesel). The fuel composition may additionally contain additives known in the art.

BRIEF DESCRIPTION OF THE FIGURE

The invention will now be described with reference to the accompanying FIGURE which shows the effect of sulphuric acid concentration on friction for 70 BN phenate solutions in 500N HV1 mineral oil.

EXAMPLES

The invention will now be further illustrated by reference to the following examples.

The term "AV" is used to denote the Total Alkalinity Value in mg KOH/g as measured by the method of ASTM D2896. The viscosity was measured by the method of ASTM D445. In numerical terms the AV corresponds to the TBN (Total Base Number).

Comparison Test 1—Copper-containing calcium phenate

Step 1

A mixture of the following ingredients (A)–(E) was reacted at 145° C./11 inches Hg:

(A) 189 parts by weight of an oil soluble 150 TBN calcium phenate, (B) 49 parts by weight of lube oil, (C) 76 parts by weight of stearic acid, (D) 14 parts by weight of copper (II) acetate, and (E) 150 parts by weight of 2-ethylhexanol.

Step 2

The resultant reaction mixture was held for 10 minutes and subsequently cooled to 100° C./1 Barg prior to addition of ingredients (F) and (G).

(F) 94 parts by weight of calcium hydroxide, and (G) 4 parts by weight of calcium acetate.

Step3

The resultant reaction mixture was heated to 130° C./11" Hg and held for 5 minutes prior to addition of ingredient (H), (H) 42 parts by weight of ethylene glycol.

Step 4

The resulting reaction mixture was held for 5 minutes prior to addition of ingredient (I).

(I) 94 parts by weight of carbon dioxide at 1 Barg.

Step 5

The resulting reaction mixture was heated to 210° C./28" Hg to remove the 2-ethylhexanol and ethylene glycol.

| Analysis of product | |
|---|---|
| Ca | 13.51% |
| S | 1.98% |
| AV | 368 mgKOH/g |
| V100 | 361 cSt |
| Cu | 1.02%. |

Example 1—Lithium-containing calcium phenate

Step 1

A mixture of the following ingredients (A)–(E) was reacted at 145° C./11 inches Hg:

(A) 189 parts by weight of an oil soluble 150 TBN calcium phenate, (B) 49 parts by weight of lube oil, (C) 78 parts by weight of lithium stearate, (D) 18 parts by weight of lithium hydroxide, and (E) 50 parts by weight of 2-ethylhexanol.

Step 2

The resultant reaction mixture was held for 10 minutes and subsequently cooled to 100° C./1 Barg by addition of ingredient (F) prior to addition of ingredients (G) and (H).

(F) 100 parts by weight of 2-ethylhexanol, (G) 94 parts by weight of calcium hydroxide, and (H) 4 parts by weight of calcium acetate.

Step 3

The resulting reaction mixture was heated to 145° C./11" Hg and held for 5 minutes prior to addition of ingredient (I).

(I) 42 parts by weight of ethylene glycol.

Step 4

B The resulting reaction mixture was held for 5 minutes prior to addition of ingredient (J).

(J) 65 parts by weight of carbon dioxide.

Step 5

The resulting reaction mixture was heated to 210° C./28" Hg to remove the 2-ethylhexanol and ethylene glycol.

| Analysis of product | |
|---|---|
| Ca | 11.98% |
| S | 1.70% |
| AV | 424 mgKOH/g |

-continued

| Analysis of product | |
|---|---|
| V100 | 283 cSt |
| Li | 1.13%. |

Example 2—Potassium-containing calcium phenate

Step 1

A mixture of the following ingredients (A)–(D) was reacted at 145° C./11 inches Hg:

(A) 189 parts by weight of an oil soluble 150 TBN calcium phenate, (B) 49 parts by weight of lube oil (C) 76 parts by weight stearic acid, and (D) 6.5 parts by weight of potassium hydroxide.

Step 2

The resultant reaction mixture was held for 10 minutes and subsequently cooled to 100° C./1 Barg by addition of ingredient (E) prior to addition of ingredients (F) and (G).

(E) 150 parts by weight of 2-ethylhexanol (G) 94 parts by weight of calcium hydroxide, and (H) 4 parts by weight of calcium acetate.

Step 3

The resulting reaction mixture was heated to 130° C./11" Hg and held for 5 minutes prior to addition of ingredient (H).

(H) 42 parts by weight of ethylene glycol.

Step 4

The resulting reaction mixture was held for 5 minutes prior to addition of ingredient (I).

(I) 94 parts by weight of carbon dioxide.

Step 5

The resulting reaction mixture was heated to 210° C./28" Hg to remove the 2-ethylhexanol and ethylene glycol.

| Analysis of product | |
|---|---|
| Ca | 13.22% |
| S | 1.92% |
| AV | 385 mgKOH/g |
| V100 | 114 cSt |
| K | 0.88%. |

Example 3—Sodium-containing, calcium phenate

Example 2 was repeated except that 14 parts by weight sodium acetate were used in place of potassium hydroxide as ingredient (D).

| Analysis of product | |
|---|---|
| Ca | 13.61% |
| S | 1.93% |
| AV | 401 mgKOH/g |
| V100 | 328 cSt |
| Na | 0.91%. |

Example 4—Molybdenum-containing calcium phenate

Example 2 was repeated except that 35 parts by weight molybdic acid were used in place of potassium hydroxide as ingredient (D).

| Analysis of product | |
|---|---|
| Ca | 13.85% |
| S | 1.91% |
| AV | 384 mgKOH/g |
| V100 | 146 cSt |
| Mo | 0.65%. |

Example 5—Rubidium-containing calcium phenate

Example 2 was repeated except that 7 parts by weight rubidium formate were used in place of potassium hydroxide as ingredient (D).

| Analysis of product | |
|---|---|
| Ca | 13.30% |
| S | 1.83% |
| AV | 372 mgKOH/g |

Example 6

The copper-containing calcium alkyl phenate concentrate of Comparison Test 1, the lithium-containing calcium alkyl phenate concentrate of Example 1, the potassium-containing calcium alkyl phenate concentrate of Example 2, the sodium-containing calcium alkyl phenate concentrate of Example 3, the molybdenum-containing calcium alkyl phenate concentrate of Example 4, the rubidium-containing calcium alkyl phenate concentrate of Example 5 and ADX 410 (a commercially available highly overbased [TBN about 400] calcium alkyl phenate ex Adibis) were each diluted with lubricating oil to 70 TBN.

Samples of each of the lubricants so-obtained were premixed with (i) 3.5% wt. concentrated sulphuric acid, and (ii) 4.5% wt. concentrated sulphuric acid to simulate the corrosive environment within the combustion chamber of a low speed, super-long stroke (SLS) marine diesel engine. Mixing of oil and acid was effected using a stirrer fitted with a dissipater head over a period of about 5 minutes. The resulting emulsion was drawn into a plastic syringe, care being taken to exclude any foam produced by the acid-base reaction.

The samples were subjected to a laboratory wear simulation technique for the development of marine cylinder lubricants details of which are published in a paper by F A Davis, A J Moore and S Pridmore delivered at the 20th International Congress on combustion engines and published by CIMAC (Council International Des Machines A Combustion) in 1993.

The test system is based on the Cameron-Plint TE-77 high frequency friction machine. The apparatus provides a reciprocating motion between a moving pin specimen and a stationary plate, the latter being attached to a small sump which also acts as the source of heat. Plate temperatures of up to 600° C. may be attained with this equipment, temperature control being provided by a four term, ramp and dwell temperature programmer. In a small but important modification to the design of the equipment, temperatures are always measured at the upper surface of the plate specimen and not at a side-face.

On-line measurements made in the course of each test include surface temperature, instantaneous friction force and the instantaneous electrical contact resistance between the sliding pair. Contact resistance is measured in terms of the potential difference (PD) between the test specimens, an open-circuit value of 50 mV representing a highly resistive and well-protected contact and a zero value reflecting high levels of potentially damaging metallic contact. Temperature and time-averaged values of friction and PD are logged by a microcomputer. A further addition to the apparatus is an on-line wear detection system based on a displacement transducer. Although out-of-plane movements of the reciprocating pin specimen are large in relation to those due to wear, the unwanted cyclic component is easily removed by digital filtering.

To obtain the required range of contact stress, a cylindrical pin specimen was used to obtain a nominally flat-on-flat contact geometry. The design of the pins means that some running-in is generally required before full conformity is achieved. With a pin of 2 mm diameter, loads in the range 80N to 250N yield nominal contact pressures of 25 to 80 MPa (250 to 800 bar).

Pin and plate specimens were manufactured from cast iron piston rings and cylinder liners, respectively. Hardnesses lay in the range 215–225 Hv20. Pin specimens were lapped to a finish of 0.05 μm $R_a$ while plate specimens were ground at 45° to the sliding direction to a finish of 0.50–0.70 μm $R_a$.

Tests were initiated with a 20 minute, lightly loaded running-in period over which the plate was raised to 50° C. At the end of this period the full load was applied and datalogging started. A second, 30 minute temperature ramp raised the plate temperature to 250° C., a condition maintained for the remaining six hours of the test. On completion of each test, pin and plate specimens were cleaned with petroleum ether and stored in a dessicator for later metallographic examination.

The derived friction coefficients are presented in Table 1 and in the accompanying FIGURE.

TABLE 1

Effect of phenate type & acid concentration on friction for 70 BN phenate solutions in 500N HVI mineral oil 70 BN 500N HVI SOLUTIONS

| PHENATE TYPE | 3.5% ACID | 4.5% ACID |
|---|---|---|
| ADX 410 | 0.055 | 0.064 |
| POTASSIUM | 0.051 | 0.048 |
| SODIUM | 0.055 | 0.053 |
| LITHIUM | 0.051 | 0.051 |
| MOLYBDENUM | 0.051 | 0.053 |
| COPPER | 0.051 | 0.080 |
| RUBIDIUM | 0.051 | 0.057 |

Reference to the FIGURE shows that at 3.5% wt. sulphuric acid most of the phenate variants show a small but significant advantage over ADX 410. Data is available to show that differences are large relative to repeatability. At 4.5% weight sulphuric acid differences widen significantly.

Example 7

70TBN 500N HVI solutions of ADX 410 and a potassium-containing calcium phenate concentrate containing 2.2% weight potassium obtained in the manner of Example 2 were treated with (i) 4.5% wt, (ii) 5.0% wt. and (iii) 5.5% wt. concentrated sulphuric acid in the manner described in Example 6. Pin wear rates and friction coefficients were determined using the Cameron-Plint TE-77 high frequency friction machine as used in Example 6. For ADX 410 the test period was 6.5 hours whereas for the potassium-modified calcium phenate the test period was 12.5 hours. The difference in these periods merely reflects the different times required to achieve stable operability.

The results of the tests are given in Table 2.

TABLE 2

| Phenate | % wt. $H_2SO_4$ 4.5 | 5.0 | 5.5 | % wt. $H_2SO_4$ 4.5 | 5.0 | 5.5 |
|---|---|---|---|---|---|---|
| | Wear rate/$10^{-17}$ $m^3$/Nm | | | Friction coefficient | | |
| ADX 410 | 0.0 | 6.1 | 10.7 | 0.069 | 0.082 | 0.086 |
| K/Ca phenate (2.2% wt K) | 0.0 | 2.9 | 3.4 | 0.044 | 0.067 | 0.071 |

Reference to the Table shows that in terms of wear rate and friction coefficient the potassium-containing calcium phenate is superior to ADX 410.

Example 8

400 TBN calcium potassium calixarate

An apparatus was set up consisting of a 1 liter wide neck round bottomed Quickfit flange flask with flange clip, flange lid incorporating an overhead stirrer, PTFE gland and stainless steel paddle, still head connected to double surface condenser with vacuum receiver, adaptor and 500 ml round bottom receiver flask cooled by a butanol/$CO_2$(s) bath and a thermocouple/Eurotherm/1 liter mantle heating system. The apparatus between the top of the mantle and the condenser was lagged with cotton wool.

A calixarene made from a mixture of 64% p-dodecylphenol, 20% 2,6-ditertiary butylphenol, 16% o-dodecylphenol and o-p-dodecylphenol as a 50% solution in SN 150 mineral oil (M. wt. 263.5 per unit, 123 g, 0.233 moles, 1 equiv.) was charged to the vessel along with potassium hydroxide (6.2 g, 0.110 moles, 0.47 equivs), stearic acid (85 g, 0.3 moles, 1.29 equivs), calcium acetate (6.0 g, 38 mmol, 0.16 equivs), a mixture of dodecylphenols (80% para-, the rest ortho- and ortho-para- di-, 9.0 g, 34 mmol, 0.14 equivs), SNI50 lubricating oil (solvent, 18.4 g) and 2-ethylhexanol (solvent, 222 g). The mixture was heated with stirring to 130° C./11" Hg vacuum for 10 minutes and then the reaction mixture was cooled to 100° C. Calcium hydroxide (90 g, 1.21 moles, 5.18 equivs) was then added and the reaction heated to 140° C. for 1 hour at 11" Hg. Ethylene glycol (42 g, 1.476 moles, 6.33 equivs) was then added and the reactants cooled to 130° C. and held with 11" Hg for 10 minutes. The vacuum was then released and the reactants carbonated at 130° C. using a dip tube connected to a Buchner flask containing solid carbon dioxide (120 g, 2.73 moles, 11.7 equivs) heated by an IR heat lamp. Carbonation was complete after 1 hour, and the mixture had become clear. The reaction mixture was then heated to 200° C. at 29" Hg and all the solvent was removed. The resulting orange-brown liquid had a crude sediment content of 3 6% and was filtered through ½ celite pad, to give a product having the following analysis:

AV=392 mg KOH/g
Ca content=13.16%
K content=1.12%

Example 9

400 TBN calcium molybdenum calixarate

The same apparatus, ingredients and procedure as used in Example 8 was employed except that instead of potassium hydroxide molybdenum (VI) oxide was used (10.7 g, 74 mmol, 0.32 equivs) and less SN 150 lubricating oil was employed (14 g, solvent).

The crude sediment was 18%. After filtration the product analysis was as follows:

AV=370 mg KOH/g
Ca content=13.1%
Mo content=0.29%

Comparison Test 2

Example 8 was repeated except that the addition of potassium hydroxide was omitted.

The resulting product was a 378 AV (mg KOH/g) calcium calixarate containing 13.5% by weight calcium.

This is not an example according to the invention because the only metal moiety in the overbased calixarate is calcium.

Example 10

70 TBN 500N HVI solutions of the calcium potassium calixarate of Example 8, the calcium molybdenum calixarate of Example 9, the potassium-containing calcium phenate (2.2% wt.K) as used in Example 7, ADX 410, and the calcium calixarate (AV 378, Ca content 13.5% wt) of Comparison Test 2 were treated with (i) 3.5% wt and (ii) 5.0% wt concentrated sulphuric acid in the manner described in Example 6. Pin wear rates, plate wear rates and friction coefficients were determined using the Cameron-Plint TE-77 high frequency friction machine as used in Example 6. The test period was 12.5 hours.

The results of the test are given in Table 3.

TABLE 3

WEAR RATES AND FRICTION COEFFICIENTS FOR 70 BN 500N HVI SOLUTIONS
250° C.; 120N load; Grade 14 cast iron pin; Grade 17 cast iron plate

| | | Wear Rate/($10^{-17}$ $m^3$/Nm) | | | | Friction Coefficient | |
|---|---|---|---|---|---|---|---|
| | | 3.5% Wt. $H_2SO_4$ | | 5.0% wt. $H_2SO_4$ | | 3.5% wt. | 5.0% wt. |
| Detergent | Example | Pin | Plate | Pin | Plate | $H_2SO_4$ | $H_2SO_4$ |
| K/Ca phenate (2.2% K) | as Ex. 2 | 0 | — | 2.9 | — | 0.044 | 0.067 |
| ADX 410 | — | | | 3.1 | 2.3 | | 0.077 |
| Ca calixarate | Comp. Test. 2 | 0 | 7.8 | 6.7 | 9.4 | 0.043 | 0.072 |
| Ca/K calixarate | 8 | | | 0 | 1.1 | | 0.061 |
| Ca/Mo Calixarate | 9 | | | 0 | 7.6 | | 0.063 |

With reference to Table 3 the results demonstrate that at 5.0%, wt. $H_2SO_4$ the incorporation of potassium into the calcium calixarate significantly reduces both plate and pin wear. In fact in terms of plate and pin wear the calcium potassium calixarate is markedly better than the commercial calcium phenate (ADX 410) which is signficantly better than the calcium calixarate. Incorporation of molybdenum into the calcium calixrate leads to greatly improved pin wear but a relatively smaller improvement in plate wear. The potassium- and molybdenum-containing calcium calixarates provide lower friction coefficients at 5% wt. $H_2SO_4$ than either the calcium calixarate or ADX 410.

We claim:

1. An overbased metal salt of a hydrocarbyl-substituted sulphurised or non-sulphurised phenol, a calixarene having a substituent hydroxyl group or groups available for reaction with metal base or a linear phenol/formaldehyde resin wherein the metal moiety comprises a first metallic component which is at least one alkaline earth metal and a second metallic component which is at least one of either (i) at least one alkali metal or (ii) at least one metal selected from Groups IIIa, IVa, Va, VIa, VIIa and VIII of either the first or the second transition series of the Periodic Table of the Elements, the weight ratio of the first metal component to the second metal component being in the range from 1000:1 to 2:1.

2. An overbased metal salt according to claim 1 wherein the first metallic component is calcium.

3. An overbased metal salt according to claim 1 wherein the second metallic component is either an alkali metal or molybdenum.

4. An overbased metal salt according to claim 3 wherein the second metallic component is lithium, potassium or molybdenum.

5. An overbased metal salt according to claim 1 wherein the weight ratio of the first metallic component to the second metallic component is in the range from 150:1 to 2:1.

6. A concentrate composition which comprises at least one overbased metal salt as claimed in claim 1 and a solvent therefor, the overbased metal salt comprising from greater than 10 to less than 90% by weight of the composition.

7. A concentrate composition according to claim 6 wherein the solvent for the overbased metal salt is a lubricating oil.

8. A concentrate composition according to claim 6 having a TBN in the range from 75 to 500.

9. A concentrate composition according to claim 6 comprising a lubricating oil and a metal non-sulphurised alkyl phenate, the concentrate having a TBN of greater than 300 and a viscosity at 100° C. of less than 1000 cSt, the metal being either a mixture of calcium and either lithium or potassium in a weight ratio of calcium to either lithium or potassium in the range from 6:1 to 25:1 or calcium and molybdenum in a weight ratio of calcium to molybdenum of from 6:1 to 50:1.

10. A process for the production of an overbased metal salt as claimed in claim 1, which process comprises reacting at elevated temperature component (A) either (i) an alkaline earth metal hydrocarbyl-substituted sulphurised or non-sulphurised phenate, or (ii) an alkaline earth metal salt of a calixarene having a substituent hydroxyl group or groups available for reaction with a metal base, or (iii) an alkaline earth metal salt of a linear phenol/formaldehyde resin, or (iv) the precursors of either (i) (ii) or (iii), component (B) an alkaline earth metal base added either in a single addition or in a plurality of additions at intermediate points during the reaction, component (C) a solvent comprising either:

(C1) either (i) a polyhydric alcohol have 2 to 4 carbon atoms, (ii) a di-($C_2$ to $C_4$) glycol, (iii) a tri-($C_2$ to $C_4$) glycol or (iv) a mono- or poly-alkylene glycol alkyl ether of the formula:

$$R^3(OR^4)_xOR^5 \quad \text{(IV)}$$

wherein in the formula (IV) $R^3$ is a $C_1$ to $C_6$ alkyl group, $R^4$ is an alkylene group, $R^5$ is hydrogen or a $C_1$ to $C_6$ alkyl group and x is an integer of 1 to 6, either alone or in combination with either (C2) a hydrocarbon solvent or (C3) either (i) water, (ii) a $C_1$ to $C_{20}$ monohydric alcohol, (iii) a ketone having up to 20 carbon atoms, (iv) a carboxylic acid ester having up to 10 carbon atoms or (v) an ether having up to 20 carbon atoms, or, (C4) a $C_1$ to $C_4$ monohydric alcohol in combination with a hydrocarbon solvent, component (E) carbon dioxide added subsequent to the, or each, addition of component (B), component (F) either a basic compound or a salt of at least one of either (i) at least one alkali metal or (ii) at least one metal selected from Groups IIIa, IVa, Va, VIa, VIIa and VIII of either the first or the second transition series of the Periodic Table of the Elements, the amounts of components (B) and (F) being such as to produce an overbased metal salt wherein the weight ratio of the alkaline earth metal of component (B) to the metal of component (F) is in the range from 1000:1 to 2:1.

11. A finished lubricating oil composition comprising a lubricating oil and an overbased metal salt as claimed in claim 1 in an amount up to 10% by weight of the composition.

12. A method of reducing wear in a part of an internal combustion engine which is moveable relative to another part of the engine and susceptible to wear thereby which method comprises applying to the moveable part of the engine an overbased metal salt as claimed in claim 1.

13. An internal combustion engine fuel composition comprising a major proportion by weight of an internal combustion engine fuel and a minor proportion by weight of an overbased metal salt as claimed in claim 1.

14. A process according to claim 10, wherein a lubricating oil component (D) is included in said reaction.

15. A process according to claim 10, wherein a component (G) is reacted in an amount sufficient to provide from 2 to 40% by weight based on the weight of the concentrate of at least one compound is which G (i) a carboxylic acid or an acid anhydride, ester or salt thereof, said acid having the formula (V)

$$R^1-\underset{\underset{R^2}{|}}{CH}-COOH \quad \text{(V)}$$

wherein $R^1$ is a $C_{10}$ to $C_{24}$ alkyl or alkenyl group and $R^2$ is hydrogen, a $C_1$ to $C_4$ alkyl group or a $CH_2COOH$ group, or G (ii) a poly-carboxylic acid containing from 36 to 100 carbon atoms or an acid anhydride, ester or salt thereof.

16. A process according to claim 10, wherein a component (H) a catalyst or promoter for the reaction is included.

17. An overbased metal salt of a hydrocarbyl-substituted sulphurized or non-sulphurized phenol, wherein the metal moiety comprises a first metallic component which is at least one alkaline earth metal and a second metallic component which is at least one of either (i) at least one alkali metal or (ii) at least one metal selected from Groups IIIa, IVa, Va, VIa, VIIa and VIII of either the first or the second transition series of the Periodic Table of the Elements, the weight ratio of the first metal component to the second metal component being in the range from 1000:1 to 2:1.

18. A concentrate composition which comprises at least one overbased metal salt as claimed in claim 17 and a solvent therefor, the overbased metal salt comprising from greater than 10 to less than 90% by weight of the composition.

19. A finished lubricating oil composition comprising a lubricating oil and an overbased metal salt as claimed in claim 17 in an amount up to 10% by weight of the composition.

20. A method of reducing wear in a part of an internal combustion engine which is moveable relative to another part of the engine and susceptible to wear thereby which method comprises applying to the moveable part of the engine an overbased metal salt as claimed in claim 17.

21. An internal combustion engine fuel composition comprising a major proportion by weight of an internal combustion engine fuel and a minor proportion by weight of an overbased metal salt as claimed in claim 17.

* * * * *